US005458106A

United States Patent [19]

Kim

[11] Patent Number: 5,458,106

[45] Date of Patent: Oct. 17, 1995

[54] CIGARETTE HOLDER WITH FILTERING RESERVOIR

[76] Inventor: Yong-sik Kim, 170-14, Sinjeong 7-dong, Yangcheon-ku, Seoul, Rep. of Korea

[21] Appl. No.: 206,518

[22] Filed: Mar. 4, 1994

[30] Foreign Application Priority Data

Oct. 27, 1993 [KR] Rep. of Korea ..... 1993-22223
Nov. 30, 1993 [KR] Rep. of Korea ..... 1993-25592

[51] Int. Cl.[6] ..... A24F 13/04

[52] U.S. Cl. ..... 131/173; 131/215.1; 131/215.3

[58] Field of Search ..... 131/173, 206, 131/215.1, 215.3

[56] References Cited

U.S. PATENT DOCUMENTS

| | | | |
|---|---|---|---|
| 1,967,438 | 7/1934 | Hartzes | 131/173 |
| 3,315,687 | 4/1967 | Menges . | |
| 4,216,785 | 8/1980 | Erickson et al. | 131/173 |
| 4,223,686 | 9/1980 | Murray, Jr. | 131/173 |
| 4,253,475 | 3/1981 | Schreiber et al. | 131/173 |
| 4,638,815 | 1/1987 | Yoshioka | 131/173 |
| 4,648,410 | 3/1987 | Seroussi | 131/173 |
| 5,080,113 | 1/1992 | Bui | 131/173 |

FOREIGN PATENT DOCUMENTS

| | | | |
|---|---|---|---|
| 67359 | 1/1915 | Austria | 131/173 |
| 1011208 | 11/1965 | United Kingdom | 131/173 |

*Primary Examiner*—Jennifer Bahr
*Attorney, Agent, or Firm*—Christie, Parker & Hale

[57] ABSTRACT

A cigarette holder having a reservoir containing a liquid filtering agent, easy to carry and to use, and preventing leakage of the filtering agent. The cigarette holder includes a cigarette receiver; a reservoir containing a liquid filtering agent; a smoke tube extending from the receiver to a point in the reservoir and below the top surface of the filtering agent; a mouthpiece extending from a point in the reservoir and above the top surface of the filtering agent to the user; and valve means for preventing leakage through the smoke tube and the mouthpiece.

4 Claims, 5 Drawing Sheets

CIGARETTE HOLDER WITH FILTERING RESERVOIR

BACKGROUND OF THE INVENTION

1. Field of the Invention

The present invention relates to an apparatus for smoking, and more particularly to a cigarette holder having a reservoir containing a liquid filtering agent such as water.

2. Description of the Prior Art

Two important types of apparatuses for smoking are a holder for cigarette and a pipe for tobacco. Function of filtering material which is contained in tobacco and does harm to smokers is often added to such apparatuses.

For the purpose of compacting the apparatus for smoking, dry material such as cotton is widely used for a filter. If the filtering is emphasized, a method of using water is applied. The examples of the type are U.S. Pat. Nos. 4,216,785 (to Ericson et al.) and 4,253,475 (to Schreber et al.). But they have bulky and complex structure.

The hookah or water pipe has been used in the Middle East for centuries to smoke organic materials such as tobacco. Since some of these substances burn harshly, the water pipe is used to make smoking them a more palatable experience. There are many types of pipes in the prior art which have a pipe bowl, a liquid filtering agent in a closed reservoir, a smoke tube extending from the pipe bowl to a point in the reservoir and below the top surface of the filtering agent, and a stem extending from a point in the reservoir and above the top surface of the filtering agent to the user. In operation, smoke passes from the bowl through the smoke tube, through a portion of the filtering agent, through a portion of the reservoir above the top surface of the filtering agent, and through the stem to the user. Such apparatus undoubtedly did provide the function of cooling and cleansing the smoke of ash, tars and other contaminants. However, the prior art pipes generally suffer from the problem of leakage of the liquid filtering agent from the reservoir into either the smoke tube or the stem, or both, while the pipe is oriented in positions other than its normal upright position.

There have been some attempts to the solution of this leakage problem. One approach to this problem is described in U.S. Pat. No. 4,223,686 to Murray Jr., which is applied only to the pipe for cigarette and includes valve means which can be closed by bending a bendable stem so that leakage to the stem may be prevented, and a capillary tube or a smoke tube.

But in order to prevent leakage of the filtering agent, the capillary tube should have a length above a certain degree, which defines the height of the pipe. Therefore the pipe according to the patent is too big to be used for a cigarette holder. And in order to apply the patent to a cigarette holder, there is another trouble that the pipe should not be upright during smoking due to leakage of the filtering agent.

Since one of the advantages of cigarette is simplicity in use, the cigarette holder should be compact, which may be the most essential condition for a commercial success.

SUMMARY OF THE INVENTION

It is the object of the present invention to provide a cigarette holder having a liquid filtering agent in a reservoir, wherein the apparatus can be made more compact and substantially immune to leakage of the filtering agent while being transported, or being emptied of ashes, or in use, regardless of its orientation.

In order to achieve the object, the present invention provides a cigarette holder comprising a cigarette receiver; a reservoir containing a liquid filtering agent; a smoke tube extending from the receiver to a point in the reservoir and below the top surface of the filtering agent; a mouthpiece extending from a point in the reservoir and above the top surface of the filtering agent to the user; and a valve for preventing leakage of the filtering agent from the reservoir or container.

BRIEF DESCRIPTION OF THE DRAWINGS

Preferred structural embodiments of the invention are disclosed in the accompanying drawings in which.

DETAILED DESCRIPTION OF THE PREFERRED EMBODIMENTS

Figure 1:
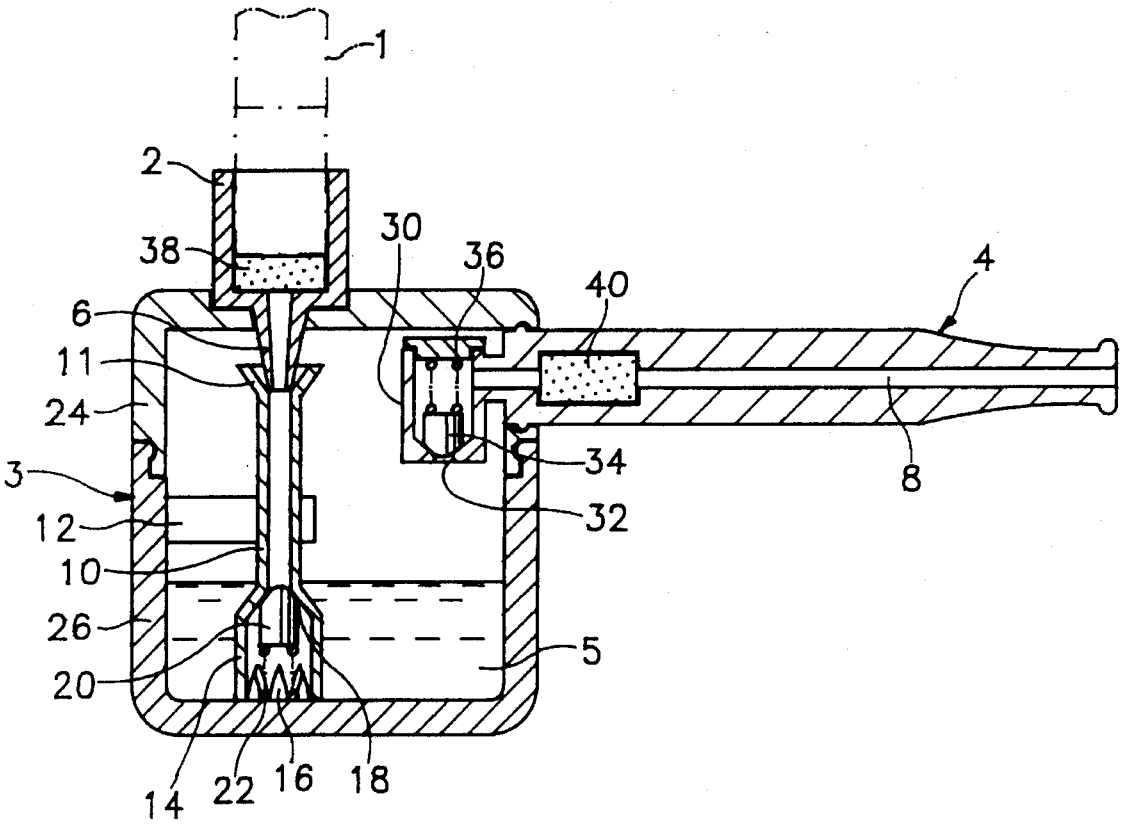
FIG. 1 is a sectional view of a first embodiment of this invention.

Reference is now made to the Figures, wherein like parts are designated by like numerals throughout. FIG. 1 illustrates a first preferred embodiment of a cigarette holder. A cigarette receiver 2 which receives an end portion of a cigarette 1 is mounted in a closed reservoir containing a liquid agent 5 such as water. A smoke passage 6 of the receiver 2, extending to a smoke tube 10 which extends to the end of the reservoir 3 and is fixed by a member 12. A funnel 11 for receiving an end of the smoke passage 6 is shaped on the top of the smoke tube 10, which is preferred for easy assembling. A mouthpiece 4 having an interior passage 8, connected to the reservoir 3 extends from a point in the reservoir 3 and above the top surface of the filtering agent 5 to the user.

Even while the reservoir 3 is being transported or is shaking regardless of its orientation, to prevent leakage of the filtering agent 5 this invention provides two stoppers 20 and 34. A first stopper 20 is positioned inside of the smoke tube 10 and linked to a first elastic member 22 for stopping an inlet 18 of the reservoir 3. A casing 30 for preventing leakage of the filtering agent 5 is connected to the interior passage 8 and has a second stopper 34 linked to a second elastic member 36 for stopping an outlet 32 of the reservoir 3. And the second stopper 34 is resiliently supported toward the outlet 32 by the second elastic member 36.

It is preferred for easy assembling to install the first stopper 20 and the first elastic member 22 as shown in FIG.

Figure 3:
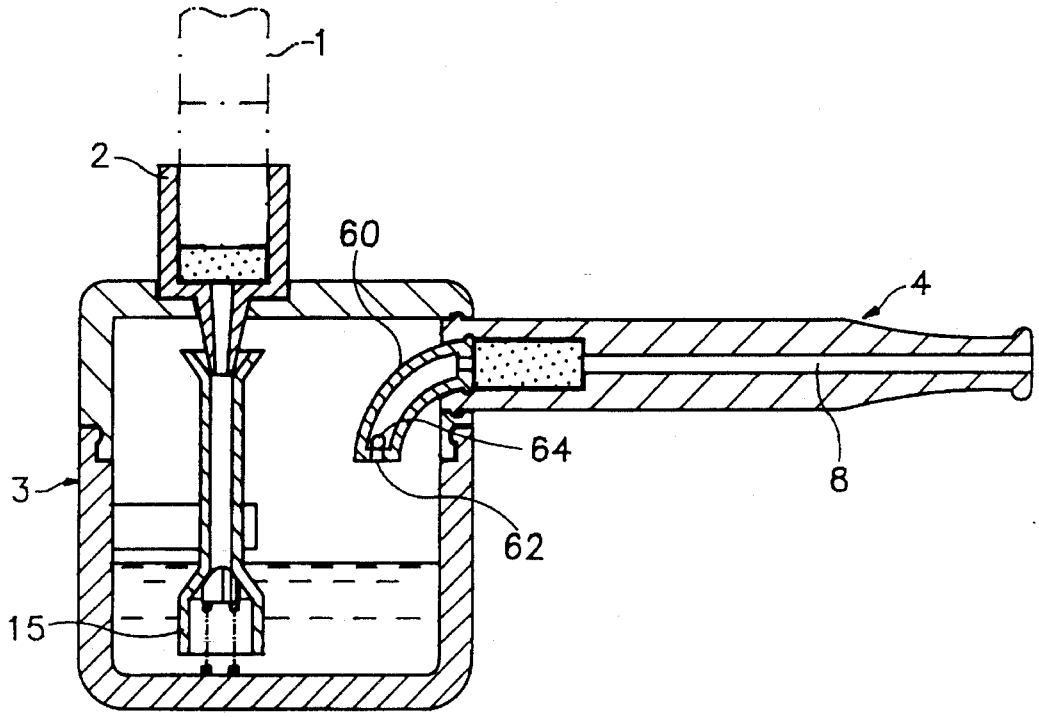
FIG. 3 is a sectional view of a third embodiment of this invention.

1. Namely, an inside diameter of an enlarged end portion 14 of the smoke tube 10 is larger than an outer diameter of the first stopper 20 which located below the inlet 18 of the reservoir 3, and the first elastic member 22 acts between the first stopper 20 and a bottom of the reservoir 3. The end of the end portion 14 with notches 16 for smoke passage can contact with the bottom of the reservoir 3 as shown in FIG. 1 or the end of the end portion 14 keeps a distance from the bottom of the reservoir 3 as shown in FIG. 3 so that a smoke passage or a gap is permitted.

In operation, smoke passes from the receiver 2 through the smoke passage 6, through the smoke tube 10, through the inlet 18, through a portion of the filtering agent 5, through a portion of the reservoir 3 above the top surface of the filtering agent 5, through the outlet 32, and through the interior passage 8 of the mouthpiece to the user.

During not smoking, the first stopper 20 and the second stopper 34 are respectively supported by the first elastic member 22 and the second elastic member 36, therefore the filtering agent doesn't leak out regardless of the orientation of the cigarette holder.

Though valve means, or the stoppers 20 and 34 and the elastic members 22 and 36 operate effectively as described above, to prevent leakage of the filtering agent 5 more perfectly, it is desirable to install dry filters 38 and 40 inside of the receiver 2 and mouthpiece 4 respectively. Gas in the reservoir 3 has high humidity, so the dry filter 40 inside the mouthpiece 4 is especially needed.

In order to facilitate assembling and cleaning, the reservoir 3 is divided into an upper housing 24 and a lower housing 26 and also the connection of two housings 24 and 26 is needed to be sealed perfectly in use. And it is desirable that the receiver 2 and the mouthpiece 4 are connected to the upper housing 24, the smoke tube 10 to the lower housing 26.

Figure 2:
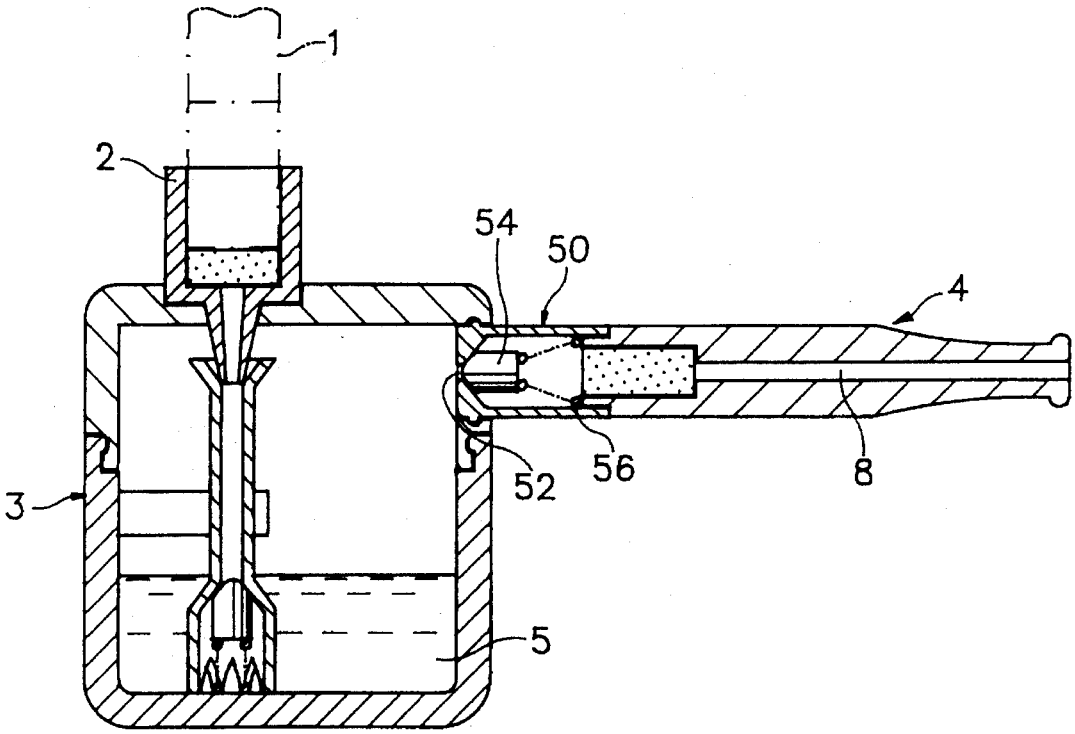
FIG. 2 is a sectional view of a second embodiment of this invention.

In a second embodiment shown in FIG. 2, a casing 50 disposed between the mouthpiece 4 and the reservoir 3 instead of inside the reservoir 3 has a second stopper 54 and a second elastic member 56 for stopping an outlet 52. The other parts of this embodiment are same as those of the first embodiment.

In a third embodiment shown in FIG. 3, a ball type stopper 64 is set on an outlet 62 in a casing 60 for blocking the outlet 62 by gravity, instead of the second stopper 34 and the second elastic member 36. The casing 60 having the ball type stopper 64 is positioned inside the reservoir 3, has the outlet 62 at the bottom and is connected to the interior passage 8 of the mouthpiece 4.

Figure 4:
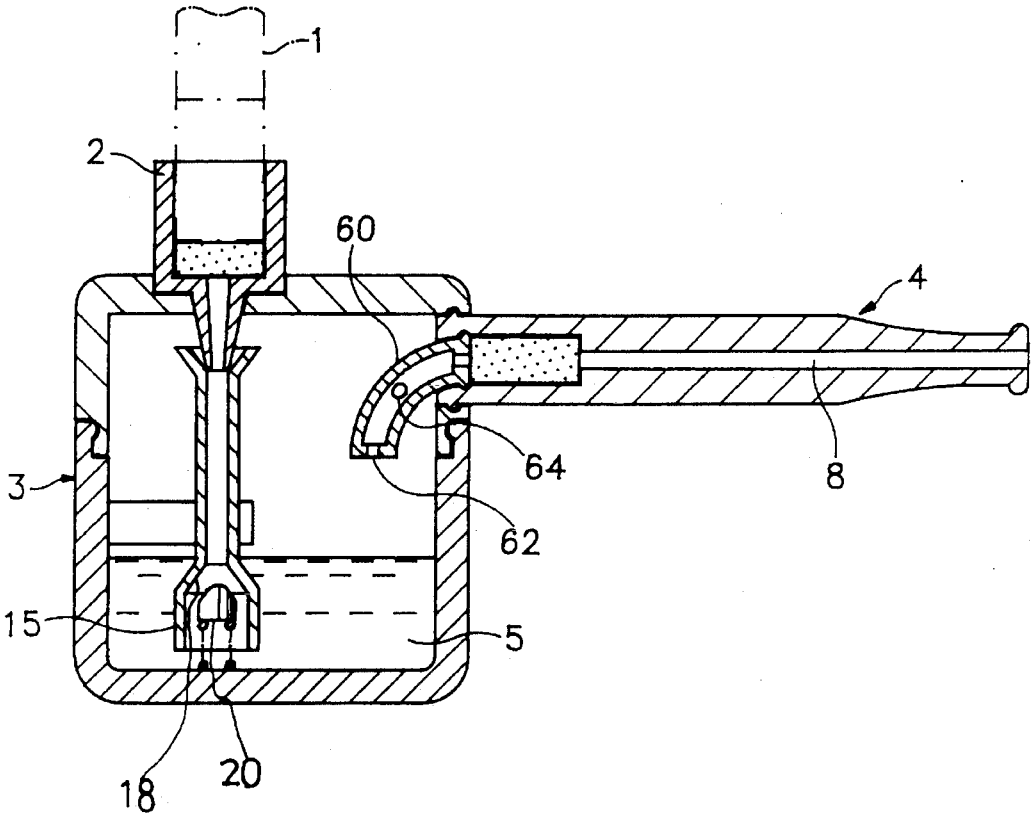
FIG. 4 is a sectional view showing a condition of the third embodiment being used or while cigarette is inhaled.

FIG. 4 illustrates an operation of the third embodiment in FIG. 3, when the user inhales smoke, the first stopper 20 becomes off from the inlet 18 and the ball type stopper 64 is raised, so that smoke can pass.

Figure 5:
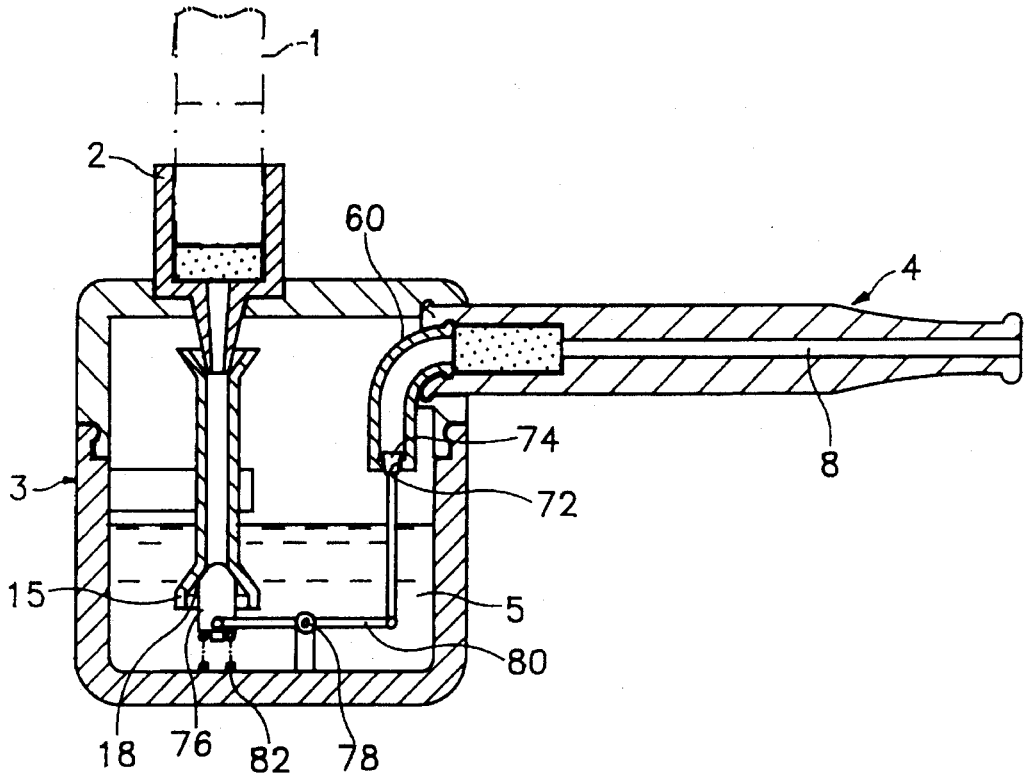
FIG. 5 is a sectional view of a fourth embodiment of this invention.
Figure 6:
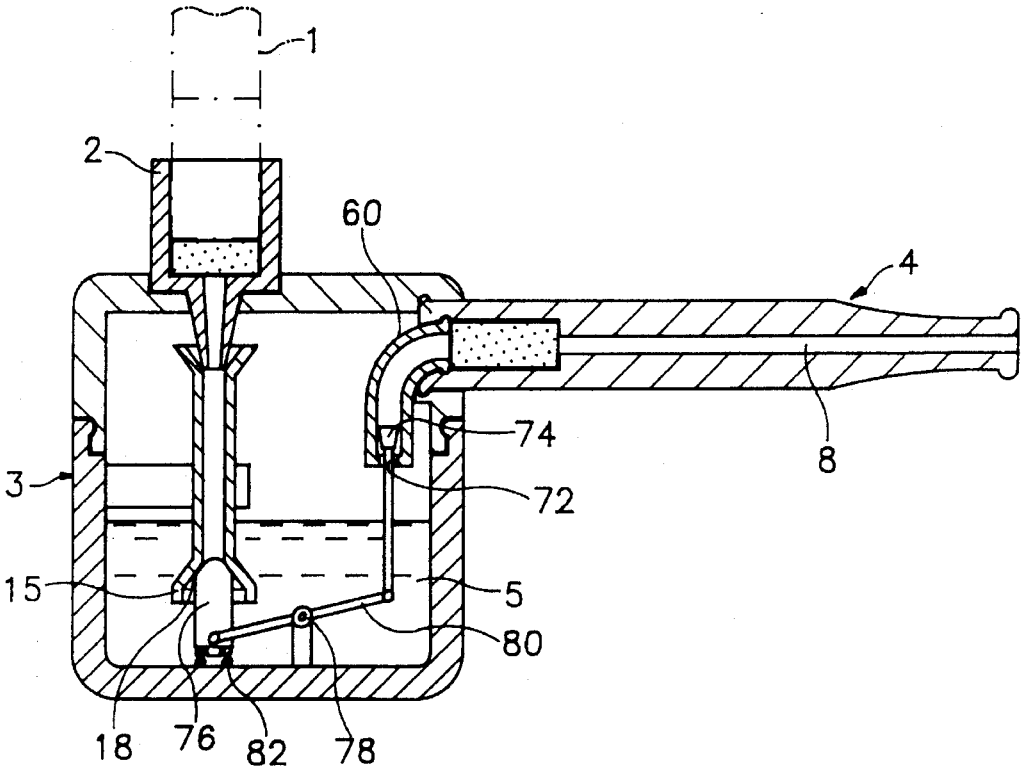
FIG. 6 is a sectional view showing a condition of the fourth embodiment being used or while cigarette is inhaled.

In a fourth embodiment shown in FIG. 5, a third stopper 76 and a fourth stopper 74 respectively opening and closing the inlet 18 and an outlet 72 are connected to a lever 80 moving with respect to a hinge 78 fixed at the bottom of the reservoir 3 and cooperate together. A third elastic member 82 allows the third stopper 76 and the fourth stopper 74 to close the inlet 18 and the outlet 72 respectively. FIG. 6 illustrates an operation of the fourth embodiment in FIG. 5, where the inlet 18 and the outlet 72 are open.

Figure 7:
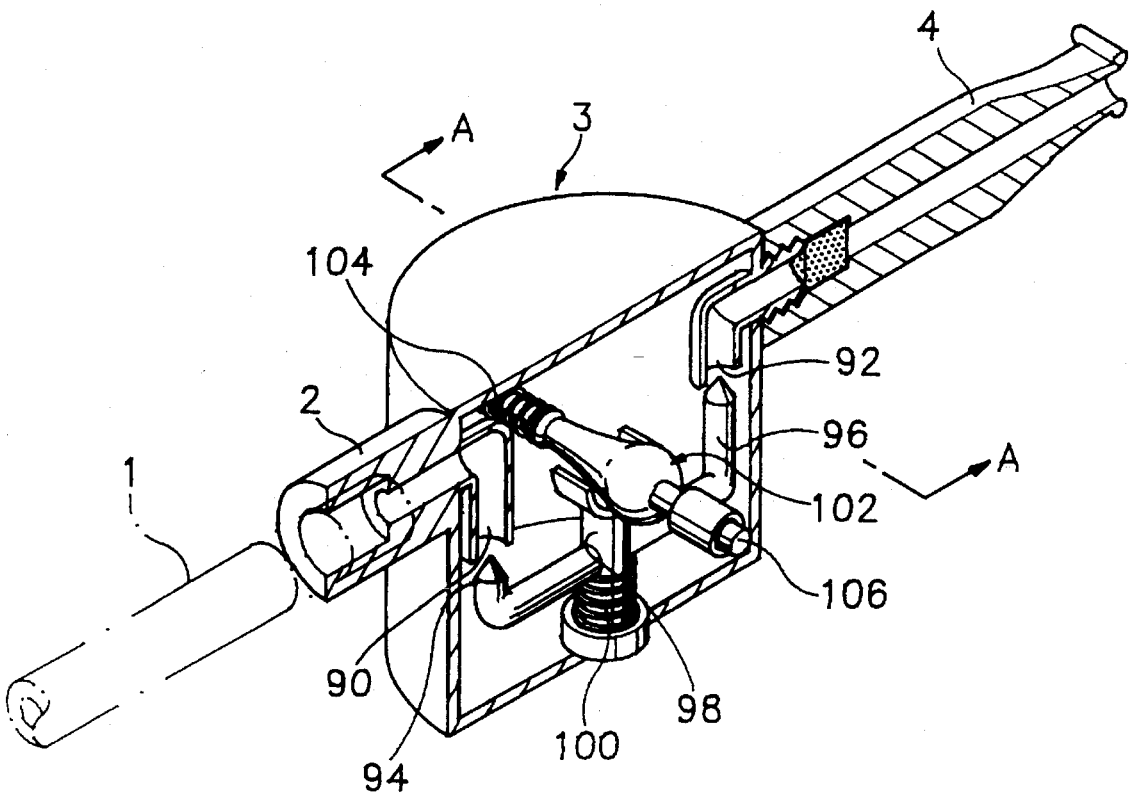
FIG. 7 is a sectional view in perspective of the fifth embodiment of this invention.

In a fifth embodiment partially cutaway shown in FIG. 7, a first rod 94 and a second rod 96 respectively stopping an inlet 90 and an outlet 92 are integrally connected with a center rod 98. A fourth elastic member supports the center rod 98 to ensure upward motion of the rods 94 and 96. A third rod 102 on the center rod 98 is for opening the inlet 90 and the outlet 92.

Figure 8:
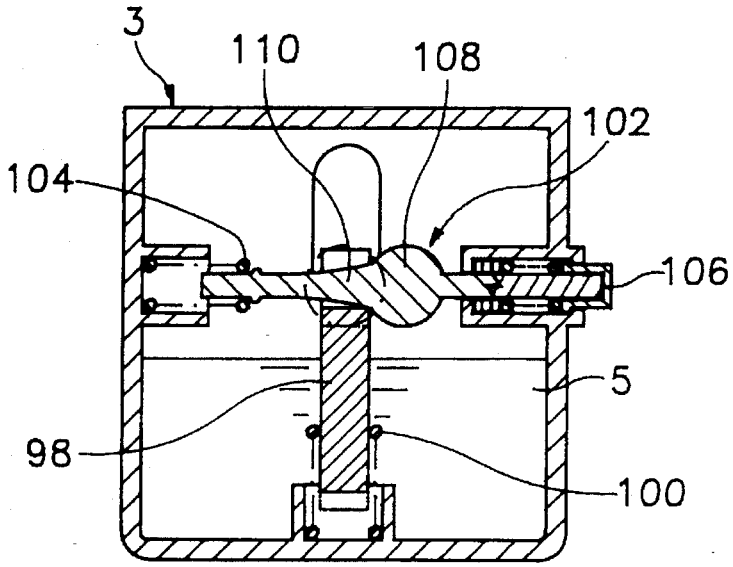
FIG. 8 is a sectional view taken substantially on line A—A of FIG. 7.

FIG. 8 is a sectional view taken substantially on line A—A of the entire fifth embodiment shown in FIG. 7. A diameter of a portion of the third rod 102 increases continuously along its axis, the axis of the third rod 102 and an axis of the center rod 98 substantially meet at right angles, and the peripheral face of the third rod 102 contacts with an upper end of the center rod 98. The third rod 102 is movable with a fifth elastic member 105 and a push button 106 which act opposite direction each other. Description of the push button 106 which is commonly used is omitted. When the push button 106 is pushed against action of the fifth elastic member 105, the third rod 102 moves to the left side in FIG. 8 and a portion 108 with a relatively large diameter of the third rod 102 comes to the portion with a dot-dash line, namely contacts with the upper end of the center rod 98. In this case, the center rod 98 with the first and the second rods 94 and 96(see FIG. 7) is pushed to the down side of the FIG. 8 against action of the fourth elastic member 100, therefore the inlet and the outlet 90 and 92 (see FIG. 7) are open. When the push button 106 is pushed once more, the third rod 102 moves slightly to the left side and soon back to the right side, a portion 110 with a relatively small diameter of the third rod 102 contacts with the upper end of the center rod 98 by a restoring force of the fifth elastic member 104 and the center rod 98 is raised by the restoring force of the fourth elastic member 100, namely same as shown in FIG. 8, therefore the inlet and the outlet 90 and 92 (see FIG. 7) are respectively closed by the first rod and the second rod 94 and 96 (see FIG. 7).

Figure 9:
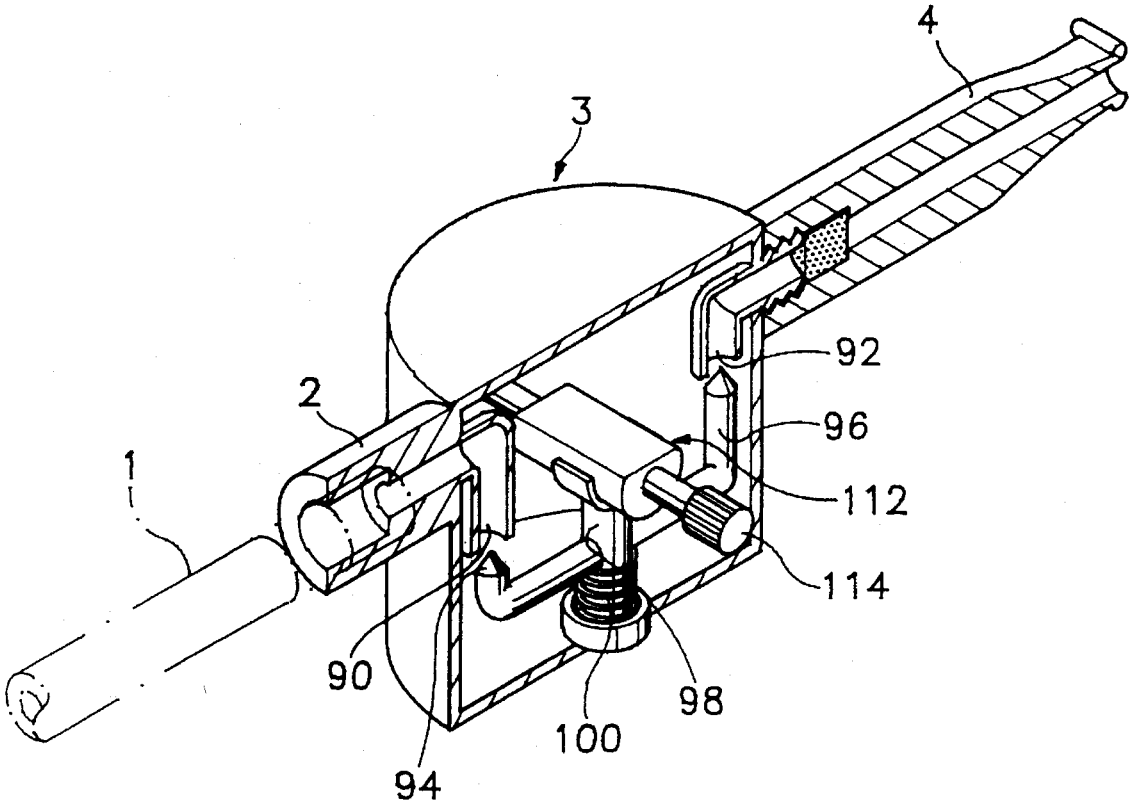
FIG. 9 is a sectional view in perspective of the sixth embodiment of this invention.

In a sixth embodiment shown in FIG. 9, a third rod 112 is formed in the shape of a cylindrical cam, an axis of the cam 112 and the axis of the center rod 98 substantially meet at right angles, and a flat face of the cam 112 contacts with the upper end of the center rod 98. When a selector 114 is turned, the center rod 98 moves up and down in accordance with a turning angle of the cam 112 and accordingly both the first and the second rods 94 and 96 selectively open and shut the inlet 90 and the outlet 92.

The fifth and the sixth embodiment are different from the other embodiments in that the inlet and outlet 90 and 92 are not open by the smoking or imbibition of the user. But because the opening and shutting of the inlet and outlet 90 and 92 can be easily done by the cam 112 and the push button 106, they can be also in practical use. As described above, this invention provides practical and useful cigarette holders which are more compact and substantially immune to leakage of the filtering agent, by simple and various valve means.

What is claimed is:

1. A cigarette holder comprising:

a reservoir containing a liquid filtering agent;

a cigarette receiver having an inlet to said reservoir below the top service of the filtering agent;

a mouthpiece having an outlet from said reservoir above the top surface of the filtering agent, said mouthpiece further having an interior passage extending from said outlet to the user; and a first rod and a second rod respectively stopping the inlet and the outlet, integrally connected with a center rod, and a fourth elastic member supporting the center rod to ensure upper motion of the first and the second rods, and a third rod acting on the center rod opposite the fourth elastic member.

2. A cigarette holder according to claim 1, wherein a diameter of a portion of the third rod increases continuously along its axis, the axis of the third rod and an axis of the center rod substantially meet at right angles, and the peripheral face of the third rod contacts with an upper end of the center rod.

3. A cigarette holder according to claim 1, further comprising a fifth elastic member supporting the third rod and a push button acting in opposite direction of it.

4. A cigarette holder comprising:

a cigarette receiver having a dry filter;

a reservoir containing a liquid filtering agent;

a smoke tube having an inlet to said reservoir below the top surface of the filtering agent, said smoke tube further having an interior passage extending from said receiver to said inlet;

a mouthpiece having an outlet from said reservoir above the top surface of the filtering agent, said mouthpiece further having an interior passage extending from said outlet to the user;

a first valve means for opening and shutting the inlet to said reservoir; and a second valve means for opening and shutting the outlet from said reservoir.

* * * * *